US005816679A

United States Patent [19]

Maeda

[11] Patent Number: 5,816,679

[45] **Date of Patent: *Oct. 6, 1998**

[54] VEHICLE LAMP AND METHOD OF MANUFACTURING THE SAME

[75] Inventor: Masahiro Maeda, Shizuoka, Japan

[73] Assignee: Koito Manufacturing Co., Ltd., Tokyo, Japan

[ * ] Notice: The term of this patent shall not extend beyond the expiration date of Pat. No. 5,779,340.

[21] Appl. No.: 549,547

[22] Filed: Oct. 27, 1995

[30] Foreign Application Priority Data

Oct. 28, 1994 [JP] Japan ..... 6-287168

[51] Int. Cl.[6] ..... F21V 7/00

[52] U.S. Cl. ..... 362/61; 362/297; 362/304; 362/346; 362/348

[58] Field of Search ..... 362/61, 304, 346, 362/347, 350, 297, 296, 341, 348; 359/869, 900

[56] References Cited

U.S. PATENT DOCUMENTS

| | | | |
|---|---|---|---|
| 1,610,124 | 12/1926 | Godley | 362/304 |
| 1,726,379 | 8/1929 | Benford . | |
| 1,903,417 | 4/1933 | Grant . | |
| 3,700,883 | 10/1972 | Donohue et al. . | |
| 4,417,300 | 11/1983 | Bodmer | 362/304 |
| 4,495,552 | 1/1985 | Graff | 362/297 |
| 4,608,512 | 8/1986 | Rakitsch | 362/297 |
| 5,034,867 | 7/1991 | Mayer | 362/348 |
| 5,136,491 | 8/1992 | Kano | 362/347 |
| 5,258,897 | 11/1993 | Nino | 362/348 |
| 5,361,193 | 11/1994 | Nino | 362/348 |
| 5,406,464 | 4/1995 | Saito | 362/348 |
| 5,408,363 | 4/1995 | Kano | 362/347 |

FOREIGN PATENT DOCUMENTS 2262980 7/1993 United Kingdom .

*Primary Examiner*—Thomas M. Sember
*Attorney, Agent, or Firm*—Sughrue, Mion, Zinn, Macpeak & Seas, PLLC

[57] ABSTRACT

To form a reflection surface, a free curved surface conformed to a configuration of a car body is set for a fundamental surface of a reflection surface. A group of paraboloids of revolution having different focal distances are set, thereby to determine a group of closed curves as the lines of intersection of the fundamental surface and the group of paraboloids of revolution. Respective paraboloids of revolution are partially allotted to a portion between each pair of the adjacent closed curves of the closed curve group. As a result, a number of reflection steps arranged in multiple loops are formed in a state that the central part of the looped reflection steps is offset from the principal optical axis of the reflection mirror.

17 Claims, 11 Drawing Sheets

VEHICLE LAMP AND METHOD OF MANUFACTURING THE SAME

BACKGROUND OF THE INVENTION

The present invention relates to a lamp of a vehicle. More particularly, the invention relates to a novel reflection mirror of a vehicle lamp which removes the difficulty in the surface working when a number of reflection step faces arranged in multiple loops are formed on a fundamental surface conformed to a configuration of a car body, and a method of manufacturing the reflection mirror.

As for recent styling of the automobiles, there is a design trend to round or streamline a car body in shape in the light of aerodynamics and design. In this circumstance, an attempt to shape the lamp so as to be conformed to a configuration of a car body and an attempt to slant the lamp face with respect to the vertical line (called the slanting of the lamp face) have frequently been made.

FIG. 17 is a view schematically showing an example of a lamp a for vehicles. As shown, the lamp a is composed of a reflection mirror b, an outer lens c covering the reflection mirror b, and a light source d, disposed in a space defined by the reflection mirror b and the outer lens c.

e designates a front nose of a car body. The outer lens c is shaped at a curvature that defines the curve of the front nose e.

f—f indicates the axis of the light source d, which extends in the direction of the front/rear of the car.

The reflection surface of the reflection mirror b is influenced by the shape of the car body. Because of this, if the reflection surface is shaped as a single paraboloid of revolution, the reflection mirror cannot provide a satisfactory function of the reflection mirror b. For this reason, the reflection surface of the reflection mirror b is shaped asymmetrical with respect to the axis f—f as shown.

In the conventional lamp, the outer lens c is used for providing the light distribution control. With the slanting of the outer lens c, the reflection mirror b must be used for the same purpose in place of the outer lens c. In this circumstance, the reflection surface of the reflection mirror b takes the form of a so-called multi-reflection surface which consists of a plural number of paraboloids of revolution or an aggregate of micro-reflection faces.

In GB 2 262 980 assigned to the same assignee of this application, there has been proposed a reflection mirror of a vehicle lamp in which the reflection surface consists of a number of reflection steps disposed about an optical axis of the reflection mirror. In the reflection mirror, the fundamental surface of the reflection surface is formed as a free curved surface. In the reflection steps allotted to the fundamental surface, the step faces are formed such that the tangential vector of a micro-reflection face at a reflection point on the reflection step is coincident with the outer product of a normal vector of the micro-reflection face at the reflection point and a normal vector of an osculating plane on the fundamental surface at the reflection point.

A metal mold for manufacturing such a reflection mirror is formed in the following steps of forming a fundamental surface of the reflection surface as a free curved surface conformed to a configuration of a car body, setting a reference line on the fundamental surface, and designating a plural number of reflection points on the reference line, setting micro-reflection faces at the reflection points by using the rule of reflection so that when light beams, which are emitted from a light source and directed to the reflection points, are reflected at the reflection points, these reflection light beams are parallel to the optical axis, and generating closed curves by a spline approximation in which the direction vectors at the plural number of reflection points arranged about the optical axis are used as the tangential vectors. In this case, the outer product of the normal vector of the micro-reflection face at the reflection point and a normal vector on the fundamental surface at the reflection point is used as the direction vector for determining the orientation of the reflection step formed. Further, V-shaped grooves are formed, which have the slant faces corresponding to the micro-reflection faces at the reflection points, along the closed curves on the metal mold.

FIG. 16 is a view showing an example of the reflection surface of a reflection mirror b which has the step faces formed by the method as mentioned above. As shown, multiple closed curves q are formed about the axis f—f of the light source d. Reflection steps are formed in a looped fashion, using the closed curves q as reference lines. In other words, adjacent closed curves are disposed so as not to intersect each other, and the axis f—f passes through the center of a group of closed curves.

When the closed curves are undulatively formed about the axis of the light source, and the reflection steps are allotted to positions along the closed curves, on the assumption that the axis of the light source (viz., the principal optical axis of the reflection mirror) always passes through the central part of the group of the closed curves, the metal mold of the reflection mirror cannot be formed on a specific portion of the reflection mirror. In other words, the specific portion of the reflection mirror cannot be used as an effective reflection surface.

FIG. 18 is an explanatory diagram for explaining why the metal mold of the reflection mirror cannot be formed on a specific portion of the reflection mirror. A front view of a surface h as a fundamental surface of the reflection surface is shown in the upper portion of FIG. 18, and closed curves i are set on the fundamental surface h. A mark "X" indicates a position where the axis f—f of the light source intersects the surface h at the central part of the group of closed curves.

A sectional view of the surface h seen from the side is illustrated in the lower portion of FIG. 18. The surface h is illustrated as a plane slanted upward to the right, for ease of explanation.

Parabolas j1 and j2 indicate the paraboloids of revolution, which form a group of paraboloids of revolution of which the axis f—f is coincident with the axis of rotation. The closed curves are formed as the lines of intersection of the surface h and the group of the paraboloids of revolution.

Since the surface h, which provides the fundamental shape of the reflection surface, is arbitrarily set as a curved surface if a group of paraboloids of revolution, of which the axis of revolution is coincident with the axis f—f of the light source, is used, on the reflection mirror, a portion where surface working cannot be performed is present between a portion (shaded by lines slanted down to the right) between the paraboloid j1 of revolution and the surface h and a portion (shaded by lines slanted down to the left) between the paraboloid j2 of revolution and the surface h (in other words, no closed curve is formed along the boundary between those slanted portions). If this location is compulsively worked, a relation between the worked portion and the surface h is lost.

SUMMARY OF THE INVENTION

To solve the problems as mentioned above, there is provided a reflection mirror of a vehicle lamp with a reflection surface formed of a number of reflection steps which are formed in a manner that a fundamental surface of the reflection mirror is defined as a free curved surface so as to be conformed to a configuration of a car body, and respective paraboloids of revolution are partially allotted to a portion between each pair of the adjacent closed curves of a group of closed curves as the lines of intersection of the fundamental surface and a group of paraboloids of revolution having different focal distances, characterized in that the reflection steps are arranged about a central part in multiple loops and the central part is offset from the principal optical axis of the reflection mirror.

According to another aspect of the present invention, there is provided a method of forming the reflection mirror of a vehicle lamp, comprising the steps of:

1) setting a fundamental surface of a reflection surface as a free curved surface conformed to a configuration of a car body;
2) setting a group of paraboloids of revolution having different focal distances;
3) determining a group of closed curves as the lines of intersection of the fundamental surface and the group of paraboloids of revolution; and
4) allotting partially respective paraboloids of revolution to a portion between each pair of the adjacent closed curves of the closed curve group, thereby forming a number of reflection steps arranged about a central part in multiple loops, the central part of the looped reflection steps being offset from the principal optical axis of the reflection mirror.

In the present invention, the point of intersection of the reflection surface and the principal optical axis of the reflection mirror is offset from the central part of the group of the closed curves. A required connection of the step faces each allotted to a portion between each pair of the adjacent closed curves is ensured. Then, a portion where face-working can not be performed, is not created on the reflection mirror.

DETAILED DESCRIPTION OF THE INVENTION

Preferred embodiments of a reflection mirror of a vehicle lamp according to the present invention will be described with reference to the accompanying drawings.

A method of forming a reflection surface will be described with reference to FIGS. 1 to 5 before description of a shape of the reflection mirror.

Figure 1:
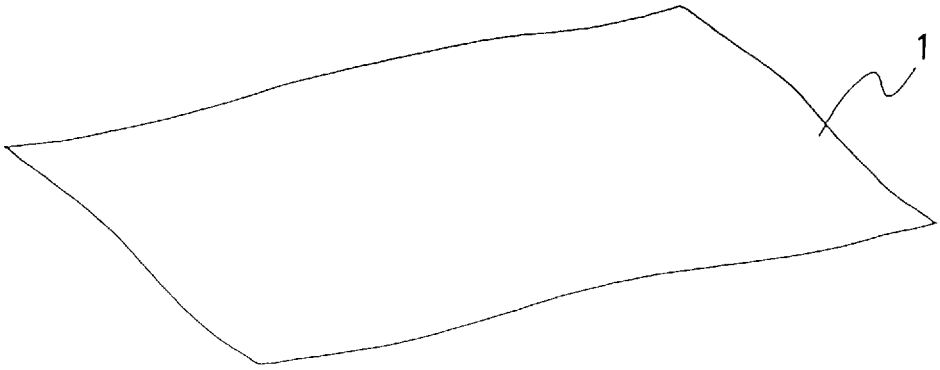
FIG. 1 is a diagram showing a free curved surface as a fundamental surface.

First, as shown in FIG. 1, a curved surface 1 which defines a fundamental shape of the reflection surface is set. The curved surface 1 as a free curved surface that cannot be mathematically expressed by an algebraical expression, is shaped so as to be conformed to a configuration of a car body, by using a CAD.

Figure 2:
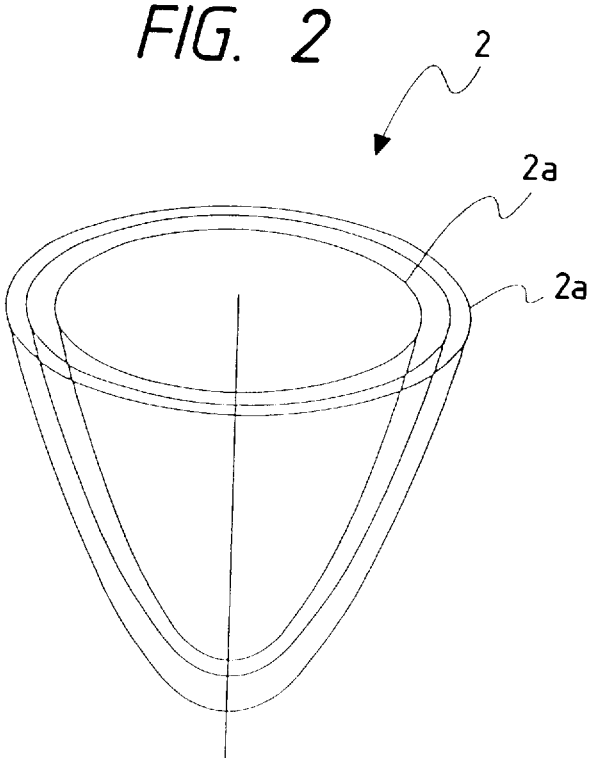
FIG. 2 is a diagram showing a group of paraboloids of revolution.

A group 2 of curved surfaces, which determines the performance of the resultant reflection surface, is prepared as shown in FIG. 2. The curved surface group 2 consists of a number of paraboloids of revolution 2*a* which have a common axis of rotational symmetry and different focal distances. The paraboloids of revolution 2*a* will never spatially intersect each other. The focal positions of the paraboloids of revolution 2*a* are not always coincident with one another (For example, the focal points may lie dispersively within a range on the axis of the rotational symmetry.).

Figure 3:
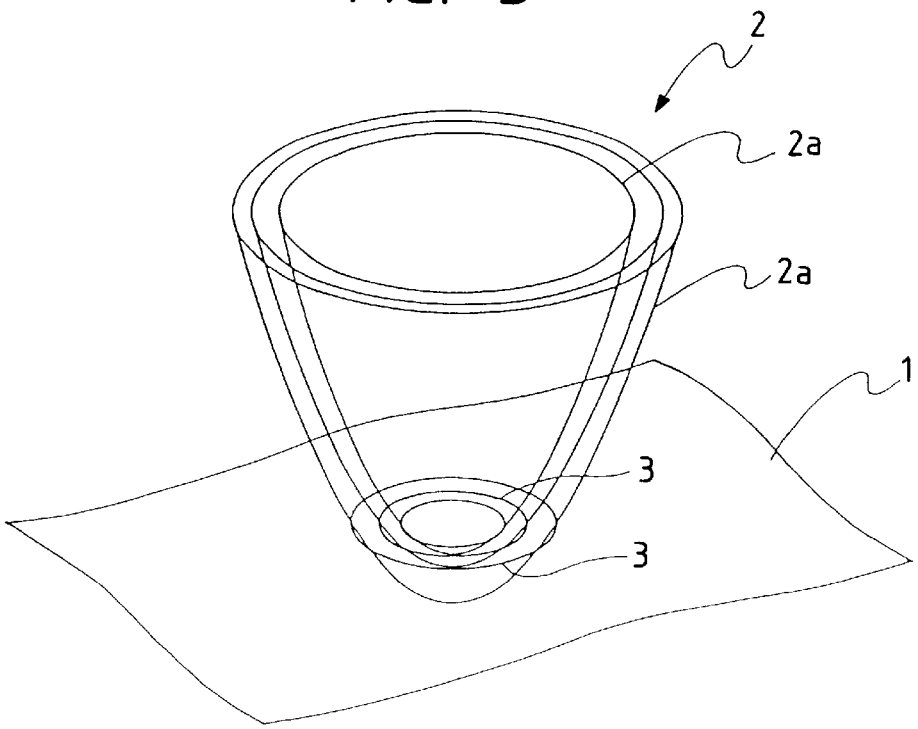
FIG. 3 is a diagram showing a group of closed curves formed in the form of the lines of intersection of the group of paraboloids of revolution and the fundamental surface.
Figure 5:
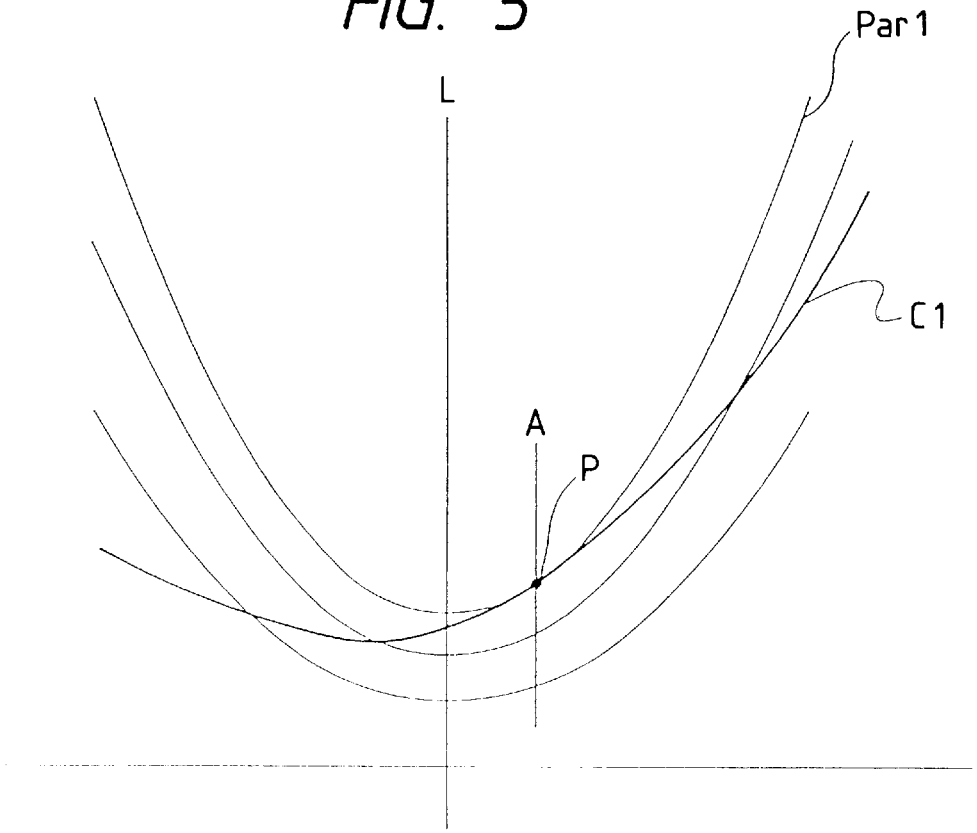
FIG. 5 is a diagram for explaining the relationship between the axis of rotational symmetry of the group of paraboloids of revolution and the center of the group of closed curves.

The lines of intersection 3 of the curved surface 1 and the curved surface group 2 are determined as shown in FIG. 3. The intersection lines 3 form closed curves or part of them. The intersection lines 3 will never intersect each other on the curved surface 1. When the curved surface 1 has an axis of rotational symmetry, the central part of the closed curves of the intersection lines 3 lies at a point where the axis of rotational symmetry intersects the curved surface. When the curved surface is not rotationally symmetric, it is determined by a point where one of the paraboloids of revolution contacts with the curved surface 1. Therefore, a point where the principal optical axis set on the reflection surface intersects the curved surface, is not always at the central part of the curved surfaces. That is, as shown in FIG. 5, when a parabola parl representing the paraboloid of revolution contacts with a curved line c1 representing the curved surface 1 at a point P, an axis A, which extends in parallel with the axis of rotation L of the paraboloid of revolution while passing through the point P, will never be coincident with the axis of rotation L.

Figure 4:
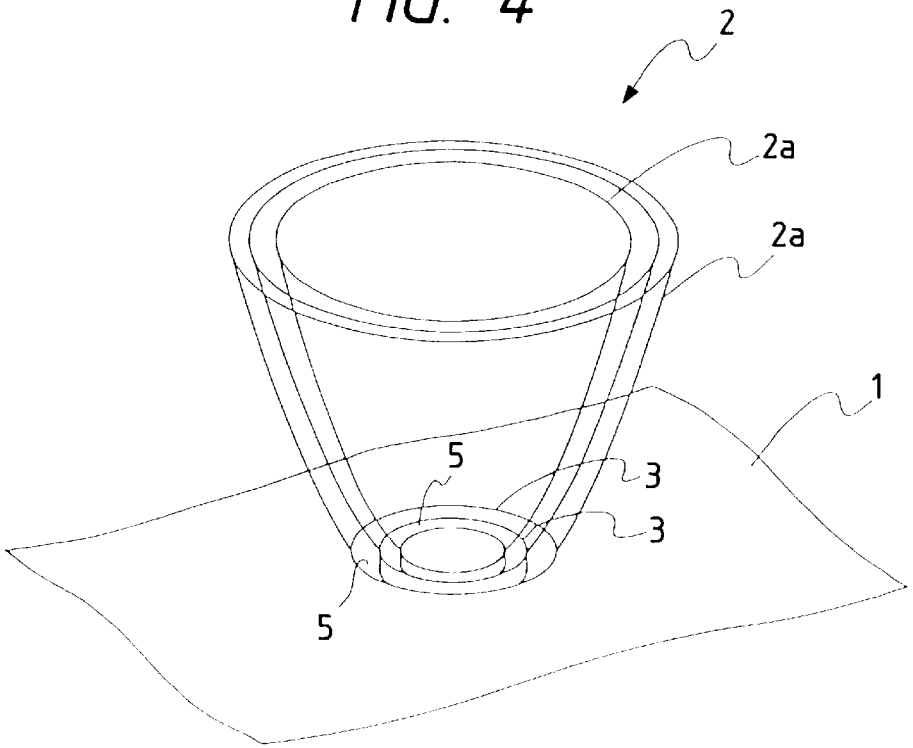
FIG. 4 is a diagram for explaining the formation of step faces.

After the intersection lines 3 are determined, reflection steps are determined on the basis of these intersection lines. As shown in FIG. 4, step faces 5 are each formed by allotting a part of the paraboloid of revolution to a portion between the adjacent curves of intersection. A front view showing the curved surface 1 is shown in the upper part of FIG. 6, and a cross sectional view showing the curved surface 1 taken along line B—B of the front view is shown in the lower part thereof. The lines of intersection are denoted as 3*a*, 3*b*, 3*c*, . . . in this order from the central part 4 of the paraboloids of revolution to the outer side. These lines of intersection define the boundaries of the step faces, respectively. In the figure, broken lines indicate the paraboloids of revolution 2. The shape of a step is regulated such that a step 5*a* is formed within the closed line 3*a* of intersection; a step 5*b* is formed between the lines 3*a* and 3*b* of intersection; a step 5*c* is formed between the lines 3*b* and 3*c* of intersection. Thus, the step faces are each formed as a part of the paraboloid of revolution, and those are arrayed in a steplike arrangement when viewed in cross section.

Figure 7A:
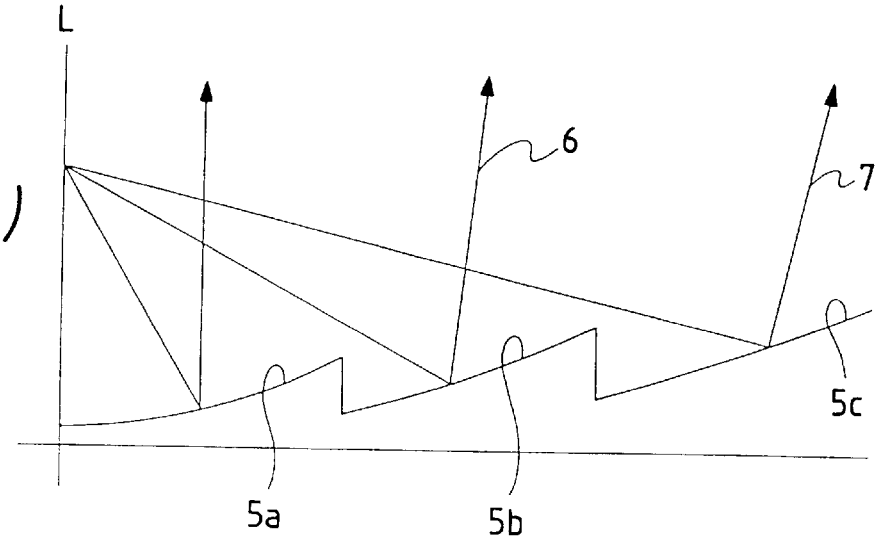
Figure 7B:
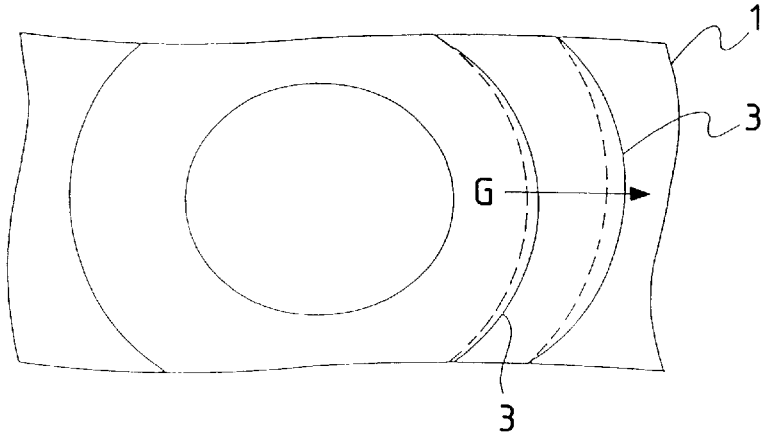
Figure 7C:
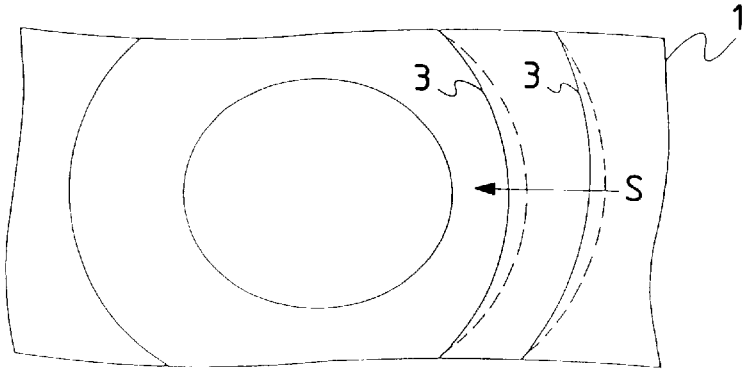

As seen from the fact that these steps are each a part of the paraboloids of revolution, when a light source is located at a common focal position thereof, the light beams reflected at the steps are parallel to the principal optical axis L of the reflection surface (viz., the axis of rotational symmetry of the paraboloids of revolution). Alternatively, the aimed direction of the reflecting light beam from the step may be varied for each step as of the light beams 6 and 7 in FIG. 7(*a*) (For example, the direction of the reflecting light beam is more outwardly slanted as the step, which reflects the light beam, is more outwardly located in the radial direction.). In this case, the curvatures of the intersection lines 3 vary with the curvatures of the curved surfaces. For example, the bulges of the intersection lines 3 increase as in the direction of an arrow G shown in FIG. 7(*b*), or those increase as in the direction of an arrow S shown in FIG. 7(*c*).

Figure 6:
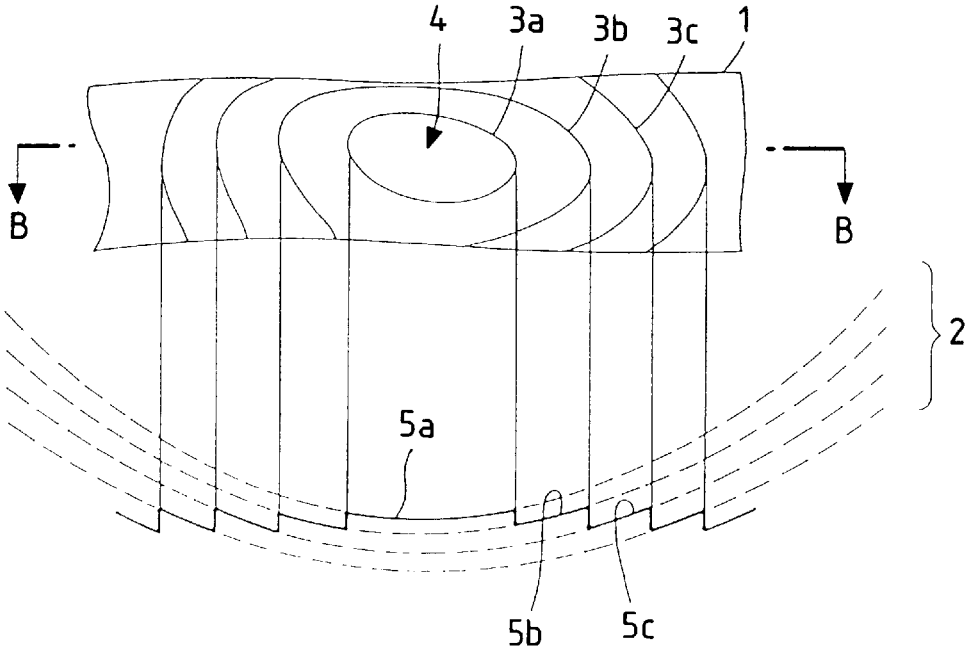
FIG. 6 is a front view of the reflection surface and a cross section of the same, FIGS. 7(*a*) to 7(*c*) are diagrams for explaining the relationship of the aiming directions of the light beams reflected at the reflection steps and the shapes of the closed curves, in which FIG. 7(*a*) is a cross sectional view of reflection steps, FIG. 7(*b*) is a plan view showing the case when the bulges of the closed curves are increased, and FIG. 7(*c*) is a plan view showing the case when the bulges of the closed curves are decreased.
Figure 8:
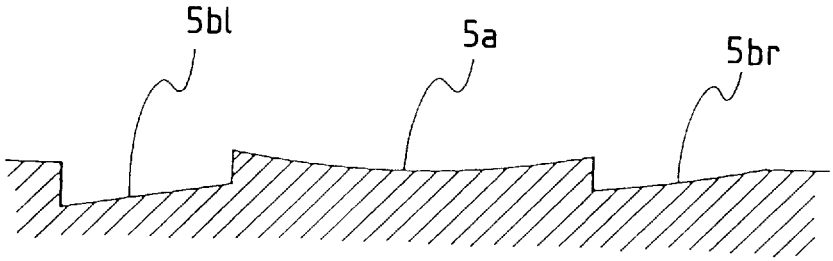
FIG. 8 is a cross sectional view showing reflections steps.
Figure 9:
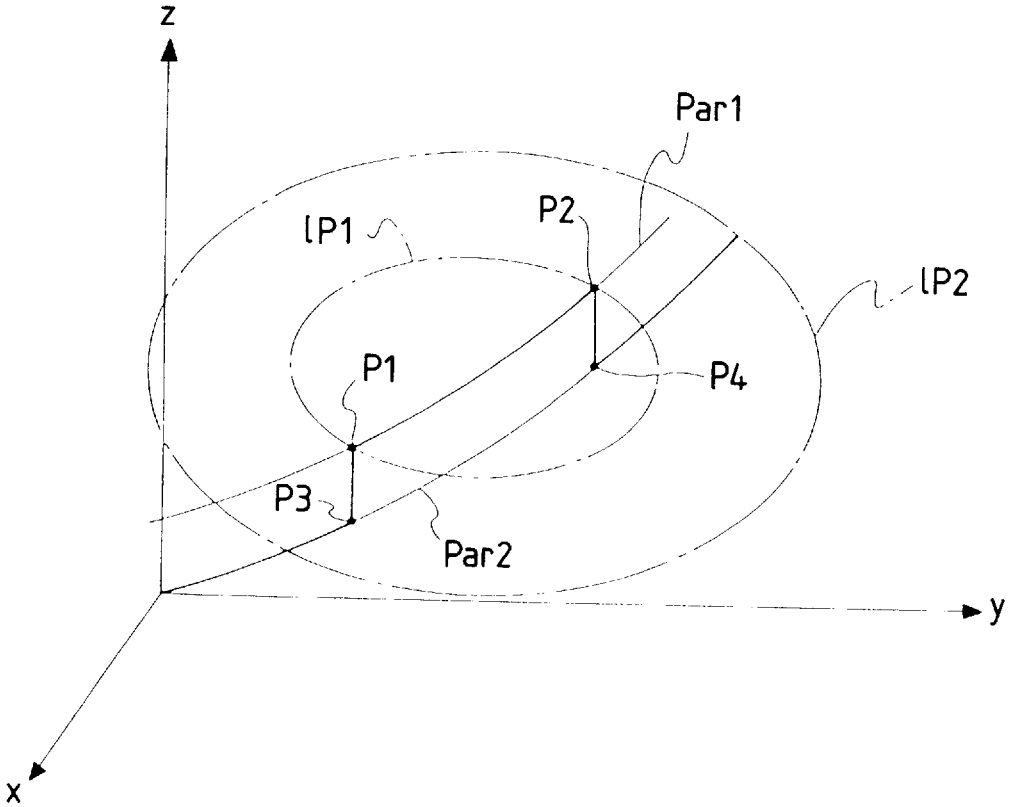
FIG. 9 is a graph showing the relationship between the group of paraboloids of revolution and the reflection steps.
Figure 10:
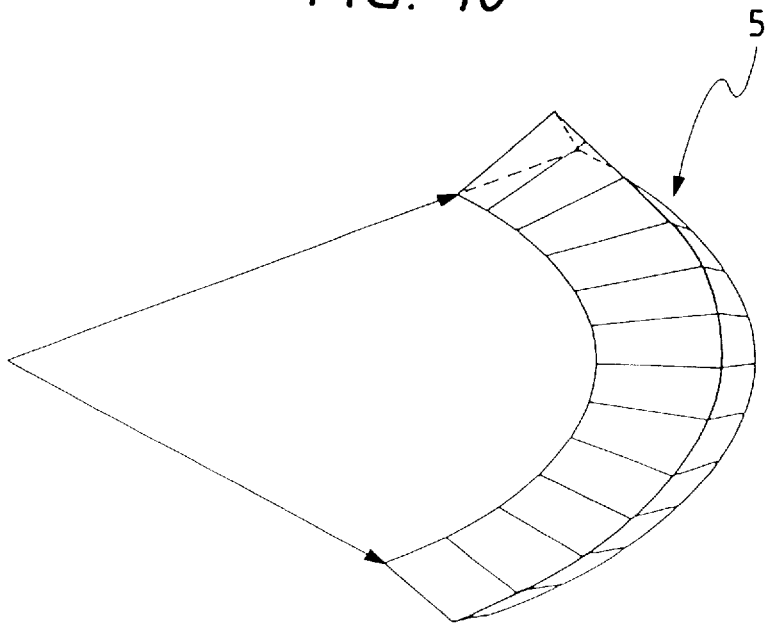
FIG. 10 is a diagram for explaining the roughness of the step face.

In FIG. 6, the slanting direction of the step on the right side of the step 5*a* is opposite to that of the step on the left side of the step 5*a* (in this case, the step is slanted down toward the central part of the closed curve). However, there may occur a case as shown in FIG. 8. In this case, the slanting direction of a step 5*br* on the right side of the step 5*a* is the same as that of a step 5*bl* on the left side thereof. For example, as shown in FIG. 9, let us consider a step allotted to a portion between a closed curve lP1 passing through points P1 and P2 where the paraboloid of revolution of the parabola parl intersects the curved surface 1, and another closed curve 1P2 passing through points P3 and P4 where the paraboloid of revolution of the parabola par2 intersects the curved surface 1. When the step is cut along a plane containing the points P1 to P4, and the z-axis (vertically extending in FIG. 9), the slanting directions of the step, when viewed in cross section, are the same. Thus, as schematically illustrated in FIG. 10, there is formed a step in which a part thereof is incurved, and another part is outcurved. Those incurved and outcurved parts are alternately connected to configure the step. The thus shaped step may be formed by the curved-surface working which uses a ball end mill.

When a reflection surface having the reflection steps formed along multiple closed curves and a reflection mirror having such a reflection surface are manufactured using the CAD, CAM data for forming a metal mold for manufacturing the reflection mirror may be gathered from the reflection surface and the reflection mirror having the same.

Figure 11:
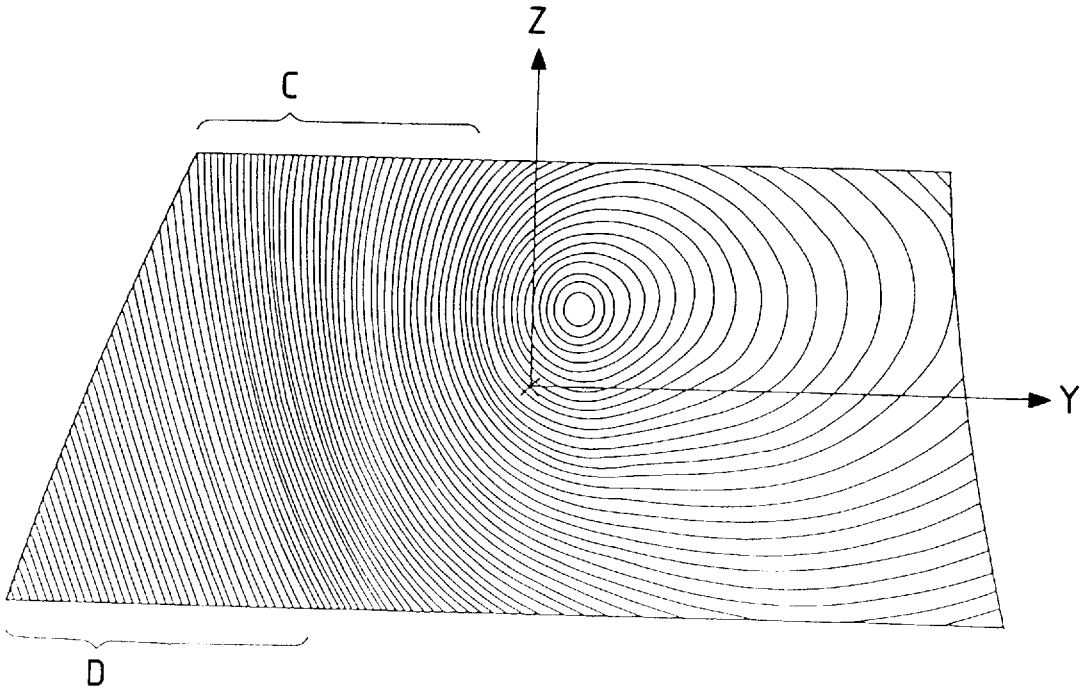
FIG. 11 is a front view showing an example of distribution of a group of closed curves on a reflection surface.
Figure 12:
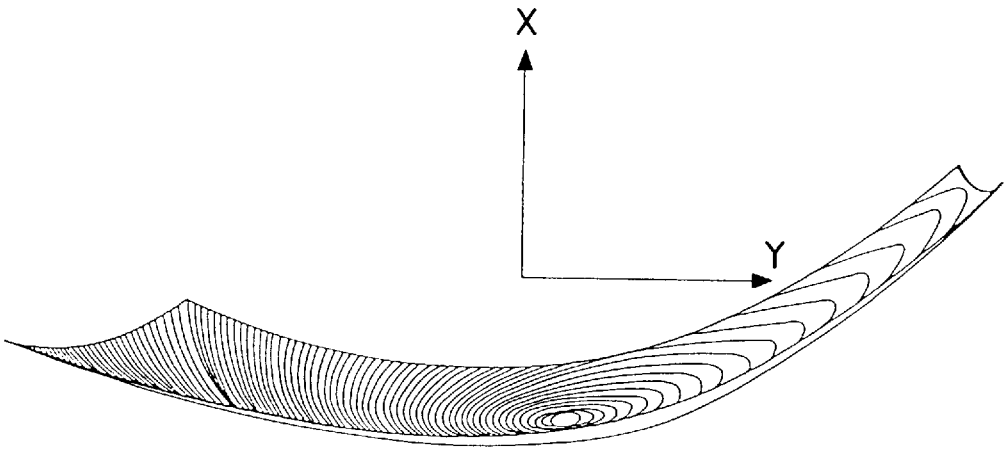
FIG. 12 is a bottom view showing the reflection surface of FIG. 11.
Figure 13:
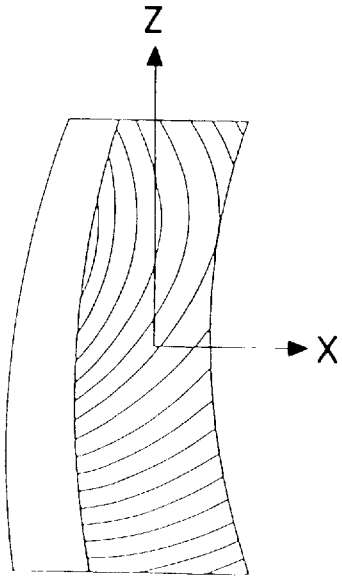
FIG. 13 is a side view showing the reflection surface of FIG. 11.

FIGS. 11 to 13 show the feature of a shape of a reflection surface manufactured by the reflection mirror manufacturing method as mentioned above. A distribution of the closed curves on a curved surface is illustrated. In the rectangular coordinates X-Y-Z of these figures, the X axis represents a principal optical axis; the Y axis, a horizontal axis; and a Z axis, a vertical axis.

As seen from a front view of FIG. 11, an intersection point (denoted as X) of the principal optical axis and the curved surface is placed at a position located obliquely downward from the central part of the closed curves. The pitches of the closed curves become larger on the right side of the central part thereof, while the pitches of the closed curves are small on the left side of the central part. More specifically, the pitches of the closed curves become larger as those are located to the right apart from the central part thereof. As for those pitches on the left side of the central part of the closed curves, the pitches within a range (denoted as C) located closer to the central part thereof is small, and the pitches in a range (denoted as D) located outside the range C are relatively large. This is due to the fact that the curvature of the curved surface as a fundamental surface on the right side of the central part of the closed curves is more greatly varied than that of the curved surface on the left side thereof, and that the curvature of the curved surface in the range C is somewhat different from that of the curved surface in the range D.

Figure 14:
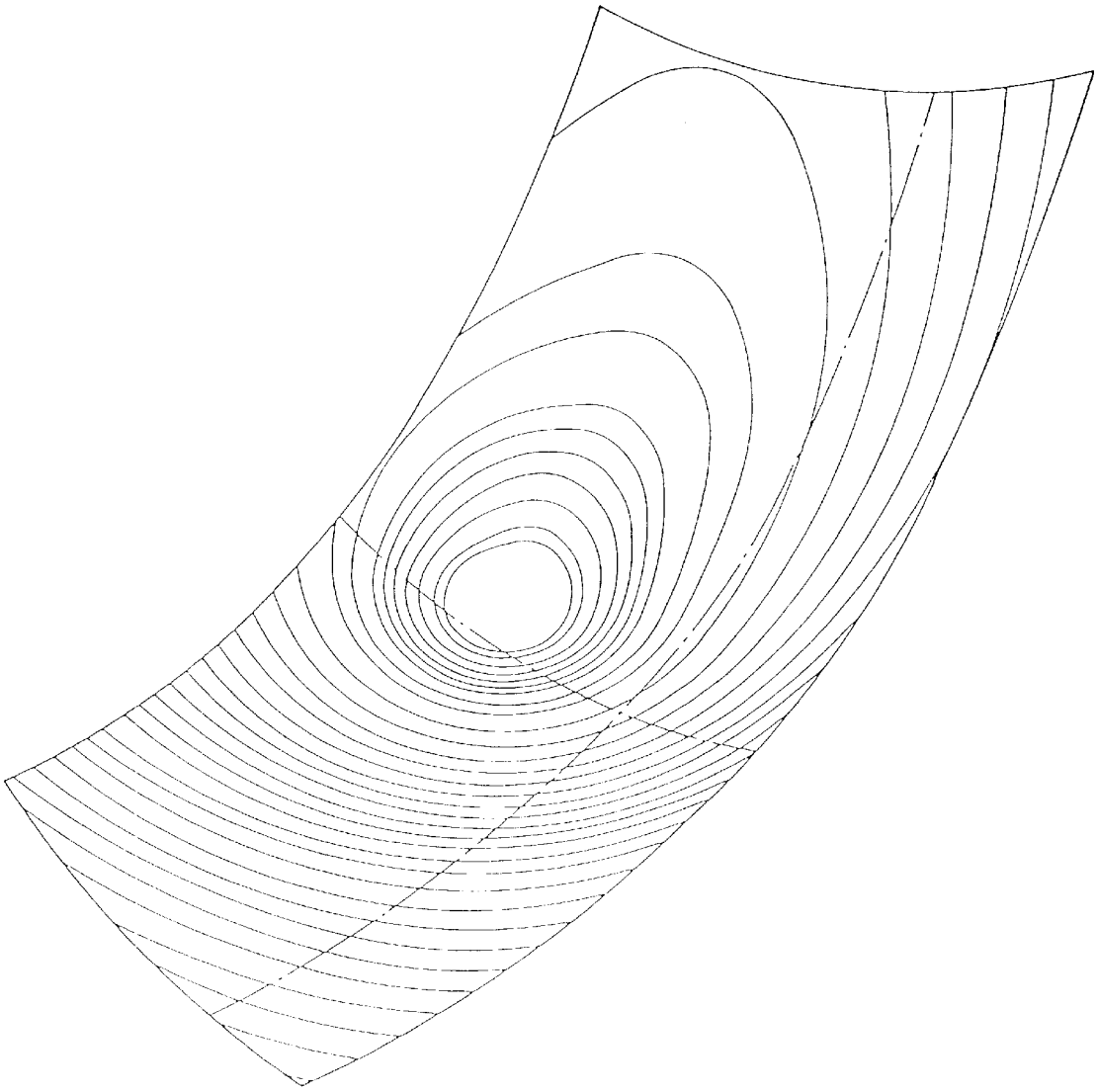
FIG. 14 is a diagram showing the feature of a group of closed curves on the reflection surface according to the present invention.
Figure 16:
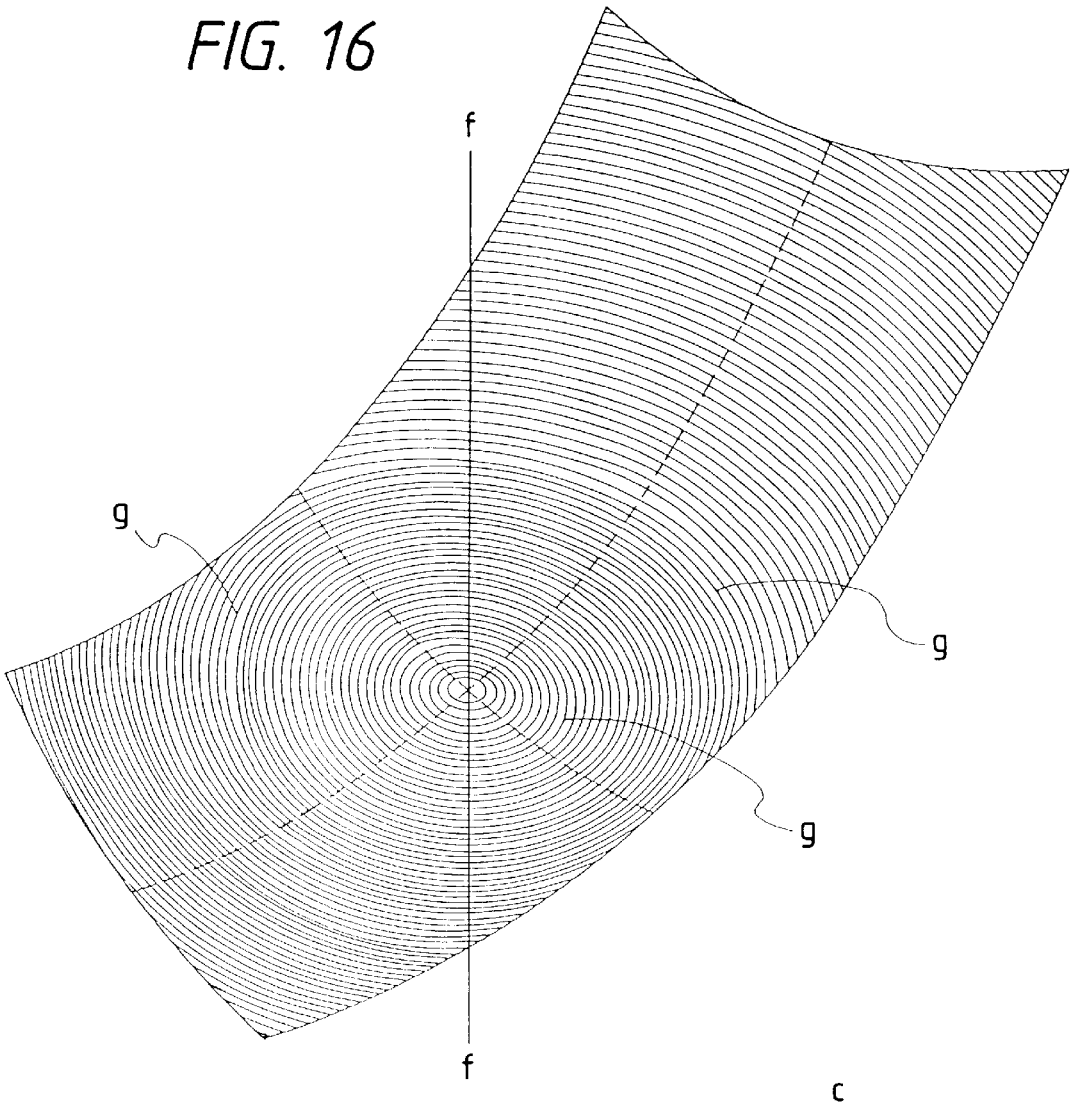
FIG. 16 is a diagram showing the feature of a group of closed curves on a conventional reflection surface.
Figure 17:
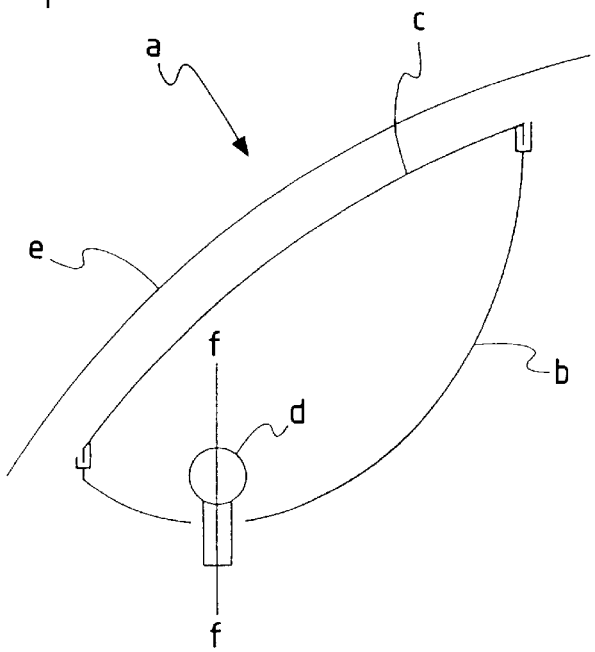
FIG. 17 is a diagram schematically showing the construction of a vehicle lamp.
Figure 18:
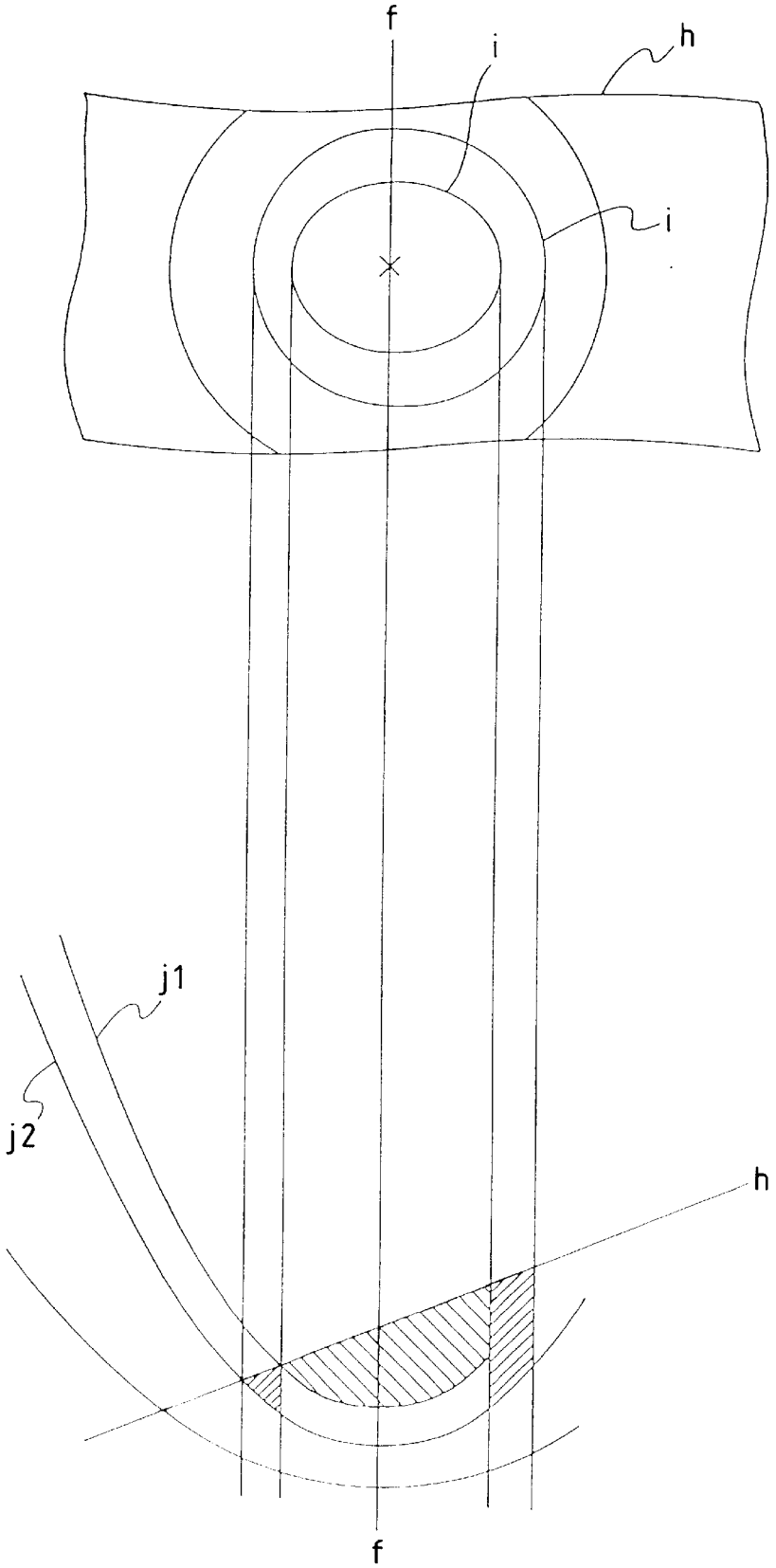
FIG. 18 is a diagram useful in explaining the problem of the conventional lamp.

FIG. 14 illustrates a distribution of closed curves on a reflection surface of the present invention in comparison with that on the reflection surface of FIG. 16. As seen, the closed curves thus distributed on those reflection surfaces are different in the asymmetry of the closed curves, the position of the central part of the closed curves, and the pitches of the closed curves.

Figure 15:
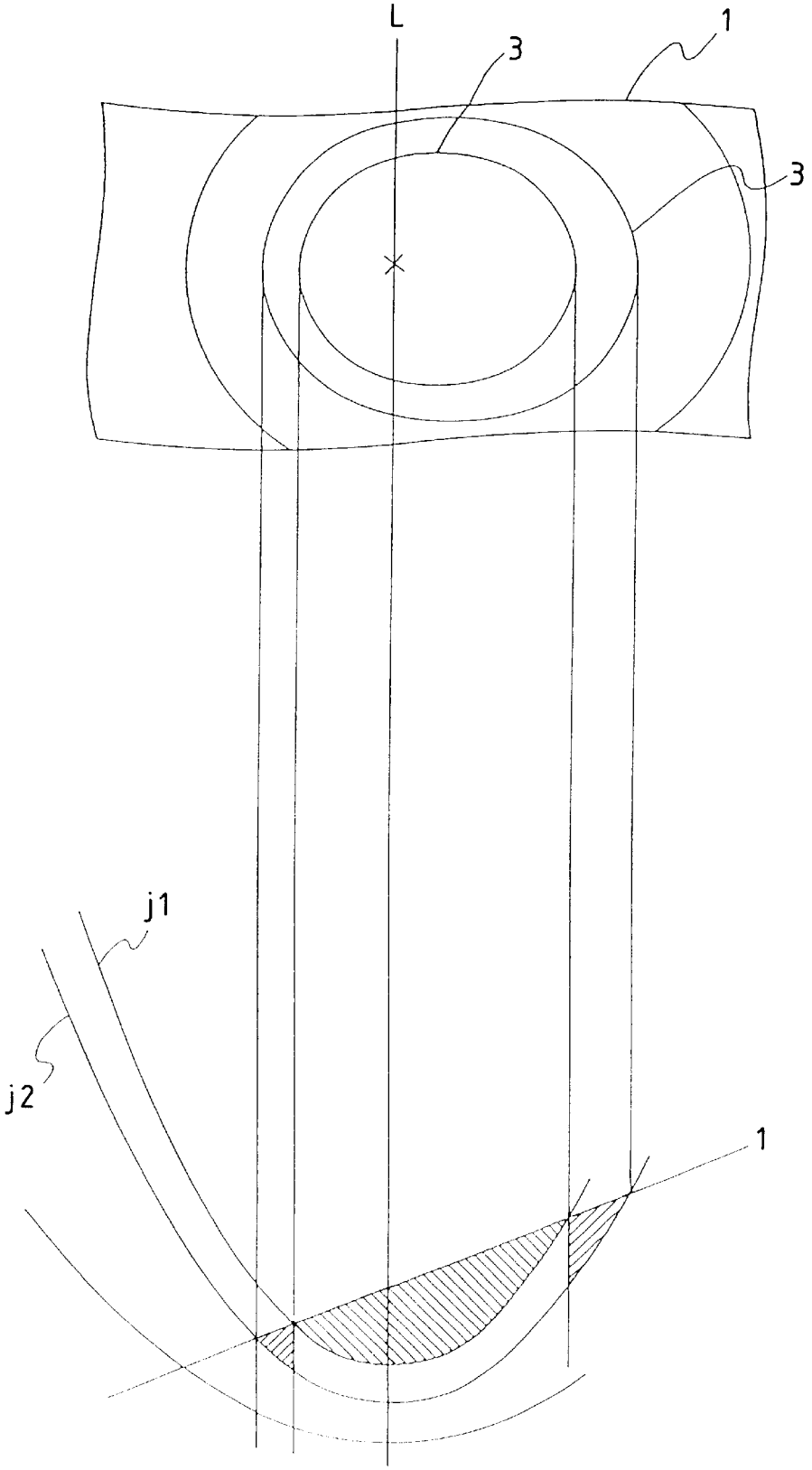
FIG. 15 is a diagram schematically showing a state in which the central part of the group of closed curves is offset from a position where the principal optical axis intersects the curved surface.

FIG. 15 schematically illustrates a state that the central part of the closed curves is offset from a point where the principal optical axis intersects the curved surface. A front view of the curved surface 1 as a fundamental surface of the reflection surface is illustrated in the upper portion of FIG. 15. Closed curves 3 are set on the curved surface 1. In the figure, a mark X indicates a point where the principal optical axis L intersects the curved surface 1. A sectional view of the curved surface 1 is illustrated in the lower portion of FIG. 15. The curved surface 1 is illustrated as a plane slanted upward to the right, for ease of explanation.

Parabolas j1 and j2 indicate the paraboloids of revolution, which form a group of paraboloids of revolution having the axis L as the axis of rotation. The closed curves are formed as the lines of intersection of the group of the paraboloids of revolution and the surface.

A closed curve appears as a boundary curve between a portion (shaded by lines slanted down to the right) between the paraboloid j1 of revolution and the curved surface 1 and a portion (shaded by lines slanted down to the left) between the paraboloid j2 of revolution and the curved surface 1. As a result, the adjacent step faces are connected while keeping the configuration of the curved surface 1.

In the reflection mirror having the reflection surface as mentioned above, the central part of the group of closed curves which defines the orientation of the reflection steps formed is offset from the principal optical axis of the reflection mirror (viz., the axis extending through the light emission center of the light source). With such a novel and unique design freedom secured, the surface working can be done without adversely affecting the connection of the step faces when the reflection steps are formed each between the adjacent closed curves as the lines of intersection of the paraboloids of revolution and the fundamental curved surface of the reflection surface. In this case, the shape of the curved surface that provides a fundamental shape of the reflection surface is faithfully transferred to the shape of the reflection step. As a result, there is eliminated an arbitrary shape correction when the step face is worked.

As seen from the foregoing description, in the reflection mirror of a vehicle lamp and the method of forming the reflection mirror according to the present invention, a free curved surface conformed to a configuration of a car body is set for a fundamental surface of a reflection surface, a group of paraboloids of revolution having different focal distances are set, thereby to determine a group of closed curves as the lines of intersection of the fundamental surface and the group of paraboloids of revolution, and the respective paraboloids of revolution are partially allotted to a portion between each pair of the adjacent closed curves of the closed curve group, whereby a number of reflection steps are arranged about a central part in multiple loops and the central part of the looped reflection steps are offset from the principal optical axis of the reflection mirror. With this, there is eliminated the necessity of forming the reflection steps about the principal optical axis of the reflection mirror in multiple loops. As a result, a required connection of the step faces each allotted to a portion between the adjacent closed curves is ensured. Then, there arises no portion where face-working of the reflection mirror can not be performed.

What is claimed is:

1. A vehicle lamp comprising a light source and a reflection mirror having a principal optical axis, said reflection mirror comprising:

a reflection surface defined by a fundamental surface and having a first plurality of reflection steps, said fundamental surface being defined as a free curved surface so as to be conformed to a configuration of a car body;

wherein said reflection steps are formed:

(a) from a plurality of paraboloids of revolution, each paraboloid defining a paraboloid surface, said plurality of paraboloids having a common axis of rotational symmetry that passes through a central part on said fundamental surface and each paraboloid intersecting with said fundamental surface to define a closed curve thereon which is adjacent to at least one other such closed curve formed by another intersection of another paraboloid with said fundamental surface, and (b) by allotting a part of said paraboloid surface for each of said respective paraboloids of revolution between adjacent ones of closed curves formed as lines of intersection of said fundamental surface and said paraboloids of revolution having different focal distances; and wherein said reflection steps are arranged in multiple loops about a central part and said central part is offset from a principal optical axis of said reflection mirror.

2. A vehicle lamp as claimed in claim 1, wherein said central part is positioned at a point where one of said paraboloids of revolution is in contact with said curved surface.

3. A vehicle lamp as claimed in claim 1, wherein a first plurality of pitches of said closed curves on a first side of said central part become larger as said pitches in said first plurality of pitches are farther located from said central part, a second plurality of pitches of said closed curves on a second side of said central part are smaller than pitches in said second plurality of pitches, and said second pitches within a first group located closer to said central part is smaller than said second pitches within a second group located outside said first group.

4. A vehicle lamp as claimed in claim 1, wherein said central part is positioned at a point where one of said paraboloids of revolution is in contact with said curved surface.

5. A method of forming a vehicle lamp having a light source and a reflection mirror with a principal optical axis, comprising the steps of;

(1) forming a fundamental surface of a reflection surface of said reflection mirror as a free curved surface conformed to a configuration of a car body;

(2) setting a plurality of paraboloids of revolution each paraboloid having different focal distances, each paraboloid defining a paraboloid surface and having a common axis of rotational symmetry that passes through a central part on said fundamental surface, (3) determining closed curves as lines of intersection of said fundamental surface and said paraboloids of revolution, each paraboloid intersecting with said fundamental surface to define a closed curve thereon which is adjacent to at least one other such closed curve formed by another intersection of another said paraboloid with said fundamental surface;

(4) allotting a part of said paraboloid surface for each of said respective paraboloids of revolution between said adjacent ones of said closed curves to form a reflection step; and (5) arranging a plural number of said reflection steps in multiple loops about said central part offset from said principal optical axis of said reflection mirror.

6. A vehicle lamp comprising a light source and a reflection mirror having a principal optical axis, said reflection mirror comprising:

a reflection surface defined by a fundamental surface and having a first plurality of reflection steps, said fundamental surface being defined as a free curved surface so as to be conformed to a configuration of a car body, wherein said steps in said plurality of reflection steps are defined by a plurality of respective paraboloids of revolution, said plurality of respective paraboloids having a common axis of revolution and defining a central part, and each said paraboloid having an internal surface, each of said plurality of reflection steps being further defined as a portion of a respective paraboloid's internal surface disposed between adjacent ones of closed curves formed as lines of intersection of said fundamental surface and adjacent ones of said paraboloids of revolution; and wherein said plurality of reflection steps are arranged in multiple loops about said central part and said central part is offset from said principal optical axis of said reflection mirror.

7. A vehicle lamp as claimed in claim 6, wherein a first plurality of pitches of said closed curves on a first side of said central part become larger as said pitches in said first plurality of pitches are farther located from said central part, a second plurality of pitches of said closed curves on a second side of said central part are smaller than pitches in said second plurality of pitches, and said second pitches within a first group located closer to said central part is smaller than said second pitches within a second group located outside said first group.

8. A vehicle lamp as defined in claim 5 wherein said paraboloids in said plurality of paraboloids of revolution have different focal distances.

9. A vehicle lamp as defined in claim 8 wherein the axis of revolution of said plurality of paraboloids of revolution is different from said principal optical axis.

10. A vehicle lamp as defined in claim 8 wherein at least two of said plurality of paraboloids of revolution have a common focal point.

11. A vehicle lamp as defined in claim 10 wherein the aimed direction of light beams reflected at the steps are primarily parallel to the principal optical axis.

12. A vehicle lamp as defined in claim 8 wherein at least two of said plurality of paraboloids of revolution have different focal points.

13. A vehicle lamp as defined in claim 12 wherein each of said different focal points lie dispursively in a range on the axis of rotational symmetry.

14. A vehicle lamp as defined in claim 13 wherein the aimed direction of light beams reflected at the steps are primarily varied for each step and are not parallel to the principal optical axis.

15. A vehicle lamp as defined in claim 8 wherein for a given step, a part thereof is incurved and a part is out curved and are alternately connected to configure said step.

16. A method of forming a vehicle lamp as defined in claim 8 wherein said paraboloids in said plurality of paraboloids of revolution have different focal distances.

17. A method of forming a vehicle lamp having a light source and a reflection mirror with a principal optical axis and a reflecting surface, said reflecting surface being defined by a fundamental surface and having at least a first plurality of reflection steps, said fundamental surface being defined as a free curved surface so as to be conformed to a configuration of a car body, comprising the steps of;

(1) forming said fundamental surface of a reflection surface of a reflection mirror as a free curved surface conformed to a configuration of a car body;

(2) generating a plurality of paraboloids of revolution, each of said paraboloids being generated about a common axis and being characterized by an internal surface;

(3) determining closed curves as lines of intersection of said fundamental surface and said paraboloids of revolution; and (4) defining a plurality of reflection steps as comprising a portion of said internal surface of said respective paraboloids of revolution between adjacent ones of said closed curves, thereby arranging said plurality of reflection steps in multiple loops about a central part offset from said principal optical axis of said reflection mirror.

* * * * *